United States Patent [19]

Asano et al.

[11] Patent Number: 4,555,064

[45] Date of Patent: Nov. 26, 1985

[54] PEBBLE-STONE CRUSHING DEVICE FOR USE IN EXCAVATOR FOR LAYING PIPELINES UNDERGROUND

[75] Inventors: Juichi Asano; Yasuo Okubo, both of Chigasaki; Hiroshi Saito, Isehara; Shigeru Harada, Hiratsuka, all of Japan

[73] Assignee: Kabushiki Kaisha Komatsu Seisakusho, Tokyo, Japan

[21] Appl. No.: 573,888

[22] Filed: Jan. 25, 1984

[51] Int. Cl.[4] ..... B02C 18/16

[52] U.S. Cl. ..... 241/89.3; 241/101.7; 241/261.2; 299/59; 299/90

[58] Field of Search ..... 299/85, 86, 90, 59, 299/55, 60, 87, 88; 241/89.3, 87.1, 88, 89.4, 261.2, 261.3, 296, 297, 298, 101.7, 261.1

[56] References Cited

U.S. PATENT DOCUMENTS 2,955,810 10/1960 McWhorter et al. ..... 299/90
3,462,089 8/1969 Whitlow ..... 241/296

FOREIGN PATENT DOCUMENTS 38084 10/1958 Poland ..... 299/89
1240879 7/1971 United Kingdom ..... 299/87
777152 11/1980 U.S.S.R. ..... 299/89

*Primary Examiner*—Mark Rosenbaum
*Attorney, Agent, or Firm*—Armstrong, Nikaido, Marmelstein & Kubovcik

[57] ABSTRACT

A pebble-stone crushing device for use in an excavator for laying pipelines underground has a plurality of rotor teeth formed integrally with the rear face of a cutter head which is mounted in the most front part of an excavator body to excavate a working face in front thereof, and a plurality of stator teeth formed radially on and integrally with an annular front face plate of said excavator body so as to cooperate with said rotor teeth. The stator teeth comprises plural groups of radially spaced apart tooth members having different length. Further, the tooth members comprises groups of comparatively long main tooth members and groups of comparatively short auxiliary tooth members each being disposed, respectively, between every adjacent two main tooth members.

5 Claims, 5 Drawing Figures

PEBBLE-STONE CRUSHING DEVICE FOR USE IN EXCAVATOR FOR LAYING PIPELINES UNDERGROUND

BACKGROUND OF THE INVENTION

1. Field of the Invention

This invention relates to an excavator for laying pipelines underground, and more particularly to a pebble-stone crushing device for use in excavator for laying pipelines underground devised to crush efficiently pebble-stone or conglomerate contained in excavated earth and sand.

2. Description of the Prior Art

In the conventional excavators for laying pipelines such as, for example, a cesspipeline underground, if relatively big pebbles are contained in the earth and sand excavated by the cutter head mounted on the leading end of the excavator, there is a risk that the pebbles prevent backward smooth transport of the earth and sand in the excavator body and the sand and earth transport pipeline connected, in turn, to the rear of the cutter head. To eliminate this risk, a pebble-stone crushing device is provided which cooperates with the rear portion of the cutter head and the front plate of the excavator body to crush pebbles contained in the excavated earth and sand to conveyable sizes. The plum-pudding stone crushing devices which have so far been employed comprise a plurality of rotor teeth formed integrally with the rear face of a cutter head and which is rotatable with the cutter head, and a plurality of stator teeth which extend radially and fixed integrally to a front face plate of the excavator body, the arrangement being made such that pebbles can be crushed between these teeth. In the pebble-stone crushing device of such a construction, the innermost peripheral distance spaced between every adjacent two stator teeth is determined by the size of pebbles which can be smoothly conveyed rearwards. Accordingly, the outermost peripheral distance spaced between every adjacent two stator teeth, that is, the size of pebbles which can be crushed between these teeth is exclusively determined if the outer diameter of the excavator body is constant. Therefore, small bore excavators for laying piperlines underground comprising an excavator body with a small outside diameter are disadvantageous in that the size of pebbles which can be crushed is extremely limited.

Further, even in cases where the outside diameter of the excavator body is sufficiently large, a considerable time is necessary to crush the largest pebbles (the size of which is equivalent to the outermost peripheral distance spaced between every two adjacent stator teeth) to a conveyable size.

If, in an excavator, the quantity of pebbles which can be crushed to a conveyable size per unit time is represented by $Q_0$, the following formula is given.

$$Q_0 = (\text{Constant}/t)$$

where t is time for crushing.

Therefore, there is a disadvantage that if a long time is taken for crushing, $Q_0$; that is, the quantity of pebbles which can be crushed per unit time is reduced so that non-crushed pebbles tend to accumulate in between the stator teeth thereby increasing the torque required to drive the cutter head or rendering the excavation and propulsion impossible in the worst case.

SUMMARY OF THE INVENTION

The present invention has been devised to eliminate the above-mentioned disadvantages, and has for its aspect to provide a plum-pudding crushing device for use in an excavator for laying pipelines underground wherein stator teeth are formed by a plurality of tooth members having different length which are properly arranged on a front face plate of the excavator body, whereby crushing remarkably large pebbles even if the outer diameter of the excavator body is small, and whereby effecting efficiently crushing of pebbles mingled in earth and sand.

To achieve the above-mentioned aspect, according to the present invention, there is provided a pebble-stone crushing device for use in an excavator for laying piperlines underground comprising a plurality of rotor teeth formed integrally with the rear face of a cutter head which is mounted in the most front part of an excavator body to excavate a working face in front thereof, and a plurality of stator teeth formed radially on and integrally with an annular front face plate of said excavator body so as to cooperate with said rotor teeth, characterized in that said stator teeth comprise plural groups of radially spaced apart tooth members having different length.

Further, according to the present invention, there is provided a pebble-stone crushing device characterized in that said tooth members comprise groups of comparatively long main tooth members and groups of comparatively short auxiliary tooth members each being disposed, respectively, between pairs of adjacent tooth members of said main tooth member groups.

Still further, according to the present invention, there is provided a pebble-stone crushing device characterized in that each of said main and auxiliary stator tooth member groups comprise two or more kinds of tooth members disposed radially of said front face plate.

The above and many other advantages, features and additional objects of the present invention will become manifest to those skilled in the art upon making reference to the following detailed description and accompanying drawings in which preferred structural embodiments incorporating the principles of the present invention are shown by way of illustrative example.

DETAILED DESCRIPTION OF THE INVENTION

Figure 1:
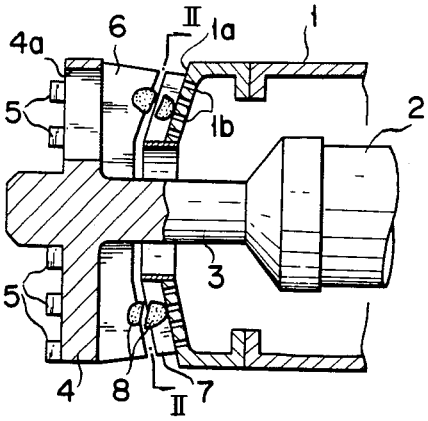
FIG. 1 PRIOR ART
FIG. 1 is a schematic longitudinal sectional view of the leading end of an excavator for laying pipelines underground provided with a prior art pebble-stone crushing device.
Figure 2:
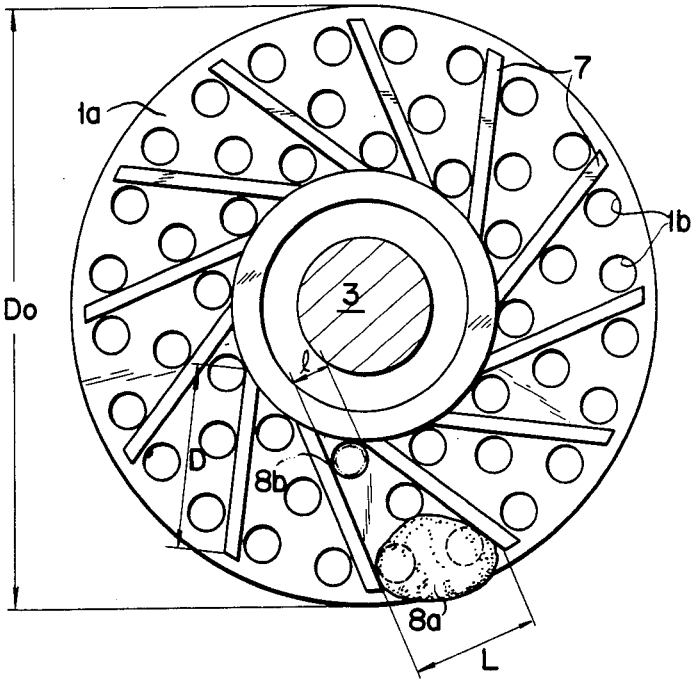
FIG. 2 PRIOR ART
FIG. 2 is a schematic plan view of a front face plate of an excavator body for laying pipelines underground which is a part of the prior art pebble-stone crushing device.

The present invention will now be described in detail below in comparison with a prior art device. A prior art pebble-stone crushing device shown in FIGS. 1 and 2 comprises a plurality of rotor teeth 6 formed integrally with the rear face of a cutter head 4 mounted in the most front part of an excavator body 1, and a plurality of stator teeth 7 formed integrally with an annular front face plate 1*a* of the excavator body 1 so as to cooperate with said rotor teeth 6. As shown in FIG. 2, the stator teeth 7 of the conventional pebble-stone crushing device have a length D from the inner periphery of the front face plate 1*a* to the outer periphery thereof and are disposed radially in such a manner that they are inclined relative to tangents of the annular front face plate 1*a* and spaced apart with one another. In this prior art device, the innermost peripheral distance l spaced between every adjacent two stator teeth is determined by the size of pebbles which can be smoothly conveyed rearwards. Accordingly, the outermost peripheral distance L spaced between every adjacent two stator teeth, that is, the size of pebbles which can be crushed between these teeth is exclusively determined if the outer diameter $D_0$ of the excavator body 1 is constant. Therefore, the aforementioned disadvantages will occur, and the distance required for crushing and moving a crushable pebble 8*a* to a pebble 8*b* of a conveyable size is equivalent to the length D of the stator teeth 7. Thereupon, a conception occurred to the inventor that the disadvantage or difficulty observed in the prior art crushing device could be eliminated by dividing the stator teeth in the radial direction thereof into several sections and disposing a short auxiliary tooth between every adjacent two stator teeth.

The plum-pudding stone crushing device of the present invention will now be described below by way of example only with reference to FIGS. 3 to 5.

Figure 3:
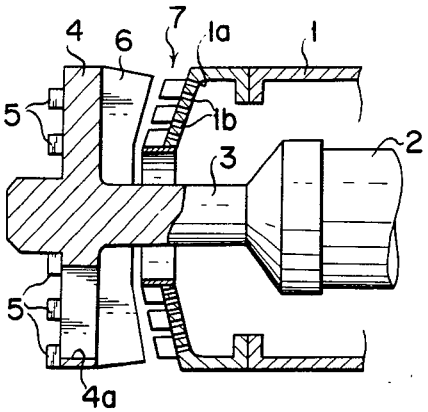
FIG. 3 is a schematic longitudinal sectional view of the leading end of an excavator for laying pipelines underground provided with a pebble-stone crushing device according to the present invention.
Figure 4:
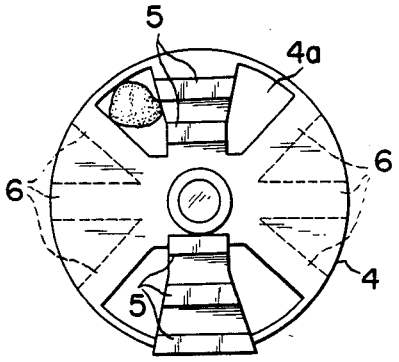
FIG. 4 is a schematic front view showing one embodiment of cutter head for use in an excavator for laying pipelines underground.

Referring to FIG. 3, there is shown a cutter head 4 which can be rotated through a revolving shaft 3 by a prime mover 2 and which is rotatably mounted on the most front part of an excavator body 1 adapted to be propelled underground by means of a propulsion device not shown. This cutter head 4 has a plurality of bits 5 formed on the front face so as to project therefrom. The propulsion device is arranged such that the bits 5 serve to excavate the working face in front of the excavator body 1 and the earth and sand excavated by the bits 5 are taken, through earth and sand intake ports 4*a* formed in the cutter head 4, into the space between the front face plate 1*a* of the excavator body 1 and the cutter head 4. Further, the plum-pudding stone crushing device according to the present invention is provided between the cutter head 4 and the front face plate 1*a* of the excavator body 1. This plum-pudding stone crushing stone comprises a plurality of rotor tooth members 6 formed radially on and projecting from the rear face of the cutter head 4 and rotatable with the cutter head, and a plurality of stator tooth members 7 fixedly secured to the annular front face plate 1*a* of the excavator body 1 and extending in substantially radial direction.

Figure 5:
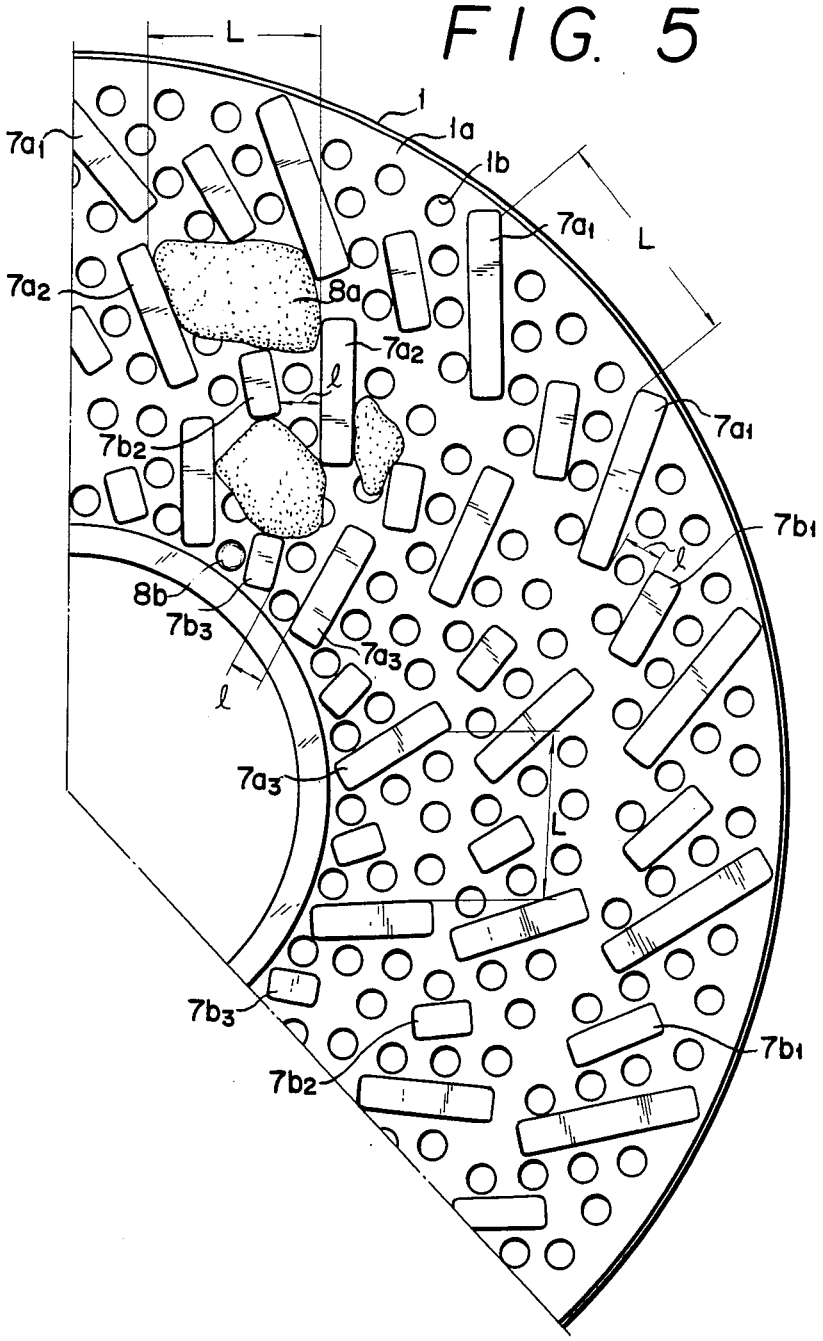
FIG. 5 is a fragmentary enlarged front view showing one embodiment of front face plate of an excavator for laying pipelines underground which is a part of the pebble-stone crushing device of the present invention.

As shown in FIG. 5, according to the pebble-stone crushing device of the present invention, the stator tooth member 7 comprises groups of comparatively long main stator tooth members $7a_1$, $7a_2$ and $7a_3$ which are divided, for example, three groups in the radial direction thereof as shown and fixedly mounted on the front face plate 1*a*, in turn, from the outer peripheral side, and groups of comparatively short auxiliary stator tooth members $7b_1$, $7b_2$ and $7b_3$ which are respectively disposed between every adjacent two stator tooth members $7a_1$ and $7a_1$, $7a_2$ and $7a_2$, and $7a_3$ and $7a_3$, in turn, from the outer peripheral side.

The pebble 8*a* having the full size which is crushable in the crushing device of the invention can be crushed in between every adjacent two stator tooth members $7a_1$ and $7a_1$, $7a_2$ and $7a_2$ or $7a_3$ and $7a_3$ which are fixedly mounted on the front face plate 1*a* at a distance L spaced apart from each other. Successively, the pebble 8*a* is further crushed to a small sized pebble 8*b* which can be smoothly conveyed rearwards in between every adjacent two stator tooth members $7a_1$ and $7b_1$, $7a_2$ and $7b_2$ or $7a_3$ and $7b_2$ which are fixedly mounted on the front face plate 1*a* at a distance l spaced apart from each other. Therefore, the distances required to move plum-pudding stones to crush them are equivalent to the length of each group of tooth members, and therefore the possibility of accumulation of plum-pudding stone between the stator teeth is eliminated thereby, in this embodiment of the invention, enabling the time required for crushing them to be reduced to about one third of those for the prior art plum-pudding stone crushing devices.

Thus, the pebbles crushed by the crushing device are taken together with the earth and sand into the inside of the excavator body 1 through a large number of earth and sand intake ports 1*b* formed in the front face plate 1*a*, and changed into slurry with water injected through nozzles, not shown, and then transported rearwards through an earth and sand transport pipeline connected to the excavator body 1.

It is to be understood that the foregoing description is merely illustrative of a preferred embodiment of the invention, and that the invention is not to be limited thereto, but is to be determined by the scope of the appended claims.

What we claim is:

1. A pebble-stone crushing device for use in an excavator for laying pipeline underground comprising an excavator body having an annular front face plate, a cutter head mounted in front of said excavator body and said front face plate for excavating a working face in front of said body and said cutter head, a plurality of rotor teeth formed integrally with the rear face of said cutter head and a plurality of stator teeth formed radially on and integrally with said front face plate of said excavator body and facing said rotor teeth, said stator teeth comprising plural groups of radially spaced apart tooth members having different length.

2. A pebble-stone crushing device as claimed in claim 1, characterized in that said tooth members comprise groups of comparatively long main tooth members and groups of comparatively short auxiliary tooth members each auxiliary tooth member being disposed, respectively, between every adjacent two tooth members in said main tooth member groups.

3. A pebble-stone crushing device as claimed in claim 1 or 2, characterized in that, out of said tooth member groups, those located radially outer on the front face plate of said excavator body are longer in length than those located radially inward on said front face plate.

4. A pebble-stone crushing device as claimed in claim 1 or 2, characterized in that, out of said tooth member groups, those located radially outer of on the front face plate of said excavator body have smaller angles relative to tangents of the front face plate than those located radially inward on said front face plate.

5. A pebble-stone crushing device as claimed in claim 2, characterized in that each of said main and auxiliary stator tooth member groups comprises at least two kinds of tooth members disposed radially of said front face plate.

* * * * *

UNITED STATES PATENT AND TRADEMARK OFFICE

CERTIFICATE OF CORRECTION

PATENT NO. : 4,555,064

DATED : November 26, 1985

INVENTOR(S) : Juichi ASANO et al

It is certified that error appears in the above-identified patent and that said Letters Patent is hereby corrected as shown below:

On the cover page, after Item [22] insert --
[30] Foreign Application Priority Data
September 29, 1983 [JP] Japan.....58-149522--.

Signed and Sealed this

*Twelfth* Day of *August 1986*

[SEAL]

*Attest:*

DONALD J. QUIGG

*Attesting Officer*

*Commissioner of Patents and Trademarks*